United States Patent [19]

Tyree, Jr. et al.

[11] 4,373,345

[45] Feb. 15, 1983

[54] ICE-MAKING AND WATER-HEATING

[76] Inventors: Lewis Tyree, Jr., 145 Briarwood Ave., North, Oak Brook, Ill. 60521; Harry C. Fischer, P.O. Box 1687, Cocoa, Fla. 32922

[21] Appl. No.: 252,159

[22] Filed: Apr. 8, 1981

[51] Int. Cl.[3] ..... F25B 7/00

[52] U.S. Cl. ..... 62/79; 62/183; 62/238.5; 62/238.6; 62/345

[58] Field of Search ..... 62/79, 238.5, 238.6, 62/183, 345

[56] References Cited

U.S. PATENT DOCUMENTS

| | | | |
|---|---|---|---|
| 1,969,187 | 8/1934 | Schutt | 62/238.5 X |
| 2,668,420 | 2/1954 | Hammell | 62/238.6 |
| 4,055,963 | 11/1977 | Shoji | 62/238.6 |
| 4,142,678 | 3/1979 | Bottum | 62/238.6 X |
| 4,154,063 | 5/1979 | Aleksandrow | 62/238.5 X |
| 4,178,769 | 12/1979 | Johnsen | 62/238.6 X |
| 4,246,764 | 1/1981 | Papadakos | 62/238.6 |
| 4,254,630 | 3/1981 | Geary | 62/79 |
| 4,285,392 | 8/1981 | Rannow | 62/238.6 |
| 4,305,456 | 12/1981 | Mueller et al. | 62/238.6 |

FOREIGN PATENT DOCUMENTS

| | | | |
|---|---|---|---|
| 144398 | 12/1930 | Switzerland | 62/238.6 |

OTHER PUBLICATIONS

Popular Science, Aug. 1980 pp. 12 and 14.

*Primary Examiner*—Lloyd L. King

*Attorney, Agent, or Firm*—Fitch, Even, Tabin, Flannery & Welsh

[57] ABSTRACT

Useful heat from an ice-maker is efficiently recovered and employed to heat water without any significant increase in the energy normally expanded in making ice. During ice-making, liquid refrigerant from a high-pressure receiver is expanded and supplied to an evaporator where ice-making occurs. Expanded refrigerant is returned to a compressor through an accumulator, and high-pressure vapor is condensed by heat-exchange with a circulating stream of water withdrawn from a storage tank. Condensed refrigerant is returned to the receiver through a restrictor. During the harvesting cycle, relatively warm, high pressure vapor from the receiver is fed to the evaporator, and any of it condensed to liquid therein is trapped in the accumulator. The compressor runs continuously throughout harvesting and ice-making, and any refrigerant trapped in the accumulator is used to subcool the high-pressure liquid prior to its expansion in the subsequent ice-making cycle.

13 Claims, 1 Drawing Figure

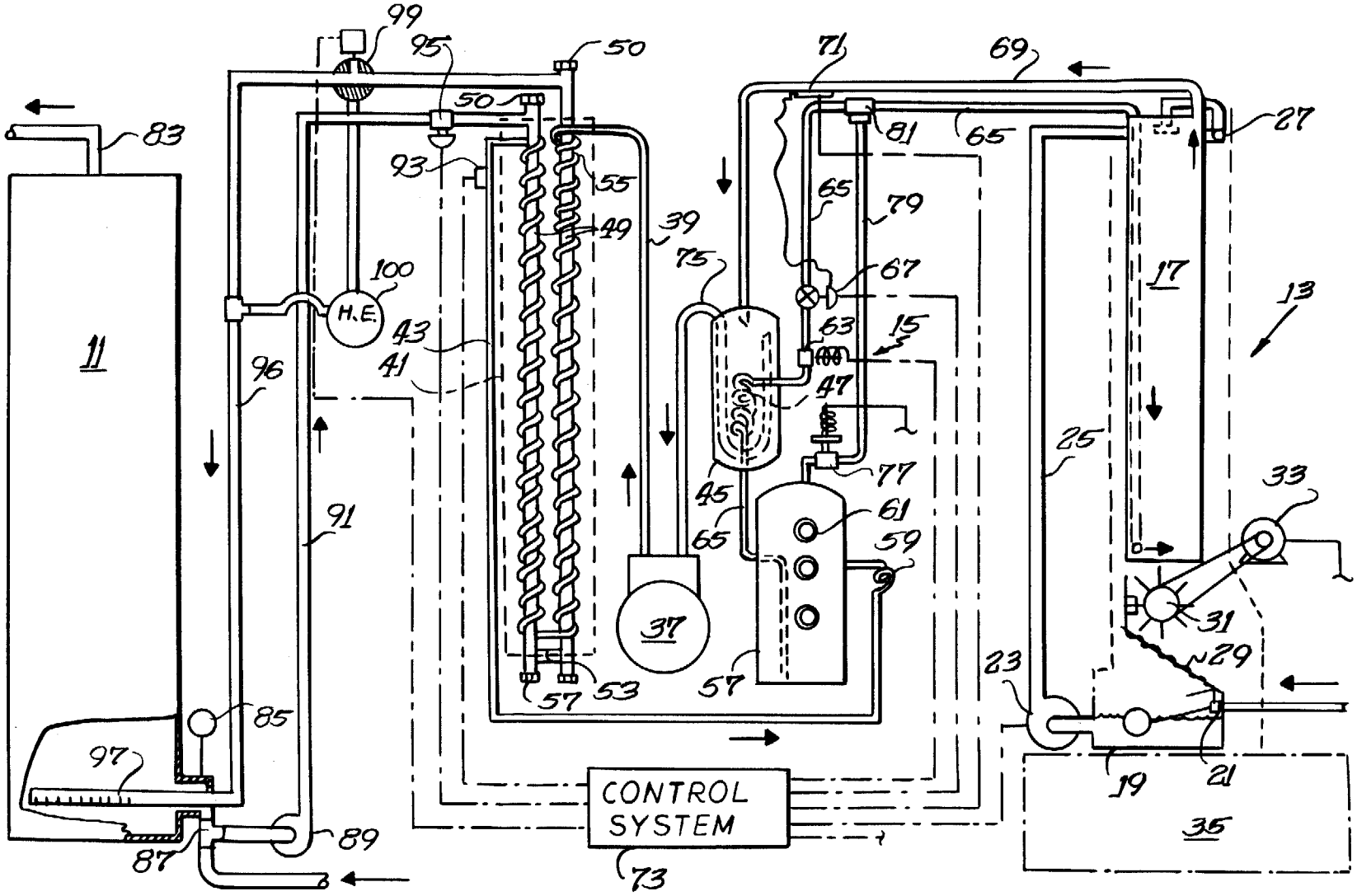
CONTROL SYSTEM
H.E.

ICE-MAKING AND WATER-HEATING

This invention relates generally to ice-making and more particularly to the economical heating of water while simultaneously freezing and then harvesting ice.

BACKGROUND OF THE INVENTION

For many years, ice-makers have been operated in order to make ice for cooling beverages or food using a wide variety of evaporators and condensers. Generally, the heat extracted from the water in order to form ice has been discarded either through the employment of an air-cooled condenser or a water-cooled condenser.

With the fairly recent significant increase of energy costs, greater consideration has been given to recovering this hitherto wasted heat. For example, the August, 1980 issue of *Popular Science* carried an article entitled "Free Hot Water From Your Air Conditioner or Heat Pump". A section in the book, *Industrial Energy Management*, T. E. Smith, 1979, Ann Arbor Science, Ann Arbor, Mich., concerns the recovery of the heat of compression for use in various heating applications. More specifically, a hot gas heat-exchanger is discussed which is designed to extract heat from the hot gas discharged by a refrigeration compressor, along with the use of that heat to warm water. The book goes on to indicate that such hot gas systems typically recover only about 5000 BTU's per hour for each 12,000 BTU's per hour of refrigeration.

Ice-making equipment generally is operated in restaurants, motels, hotels and the like all year around and stands as a ready candidate for the economical supply of heat for a water-heating or pre-heating system. The efficient and economical adaptation of ice-making equipment to the heating of water is desirable.

SUMMARY OF THE INVENTION

The present invention combines ice-making with water-heating and achieves efficient recovery of useful heat without any significant increase in the energy required to produce the desired refrigeration effect in the ice-maker. Moreover, the efficiency of the combined apparatus is such that it can recover rejected heat in an amount equal to nearly twice the number of BTU's per hour of refrigeration. Refrigerant vapor from a receiver, located between the condenser and the evaporator, is employed to effect the harvesting operation while the compressor runs continuously during the operation of the equipment and the condenser continues to transfer heat to the water stream during the harvesting operation. Refrigerant vapor that is condensed in the evaporator during the harvesting cycle is retained in an accumulator upstream of the compressor and is subsequently evaporated in a manner which pre-cools the high-pressure liquid refrigerant prior to its expansion in a subsequent ice-freezing cycle.

BRIEF DESCRIPTION OF THE DRAWING

The FIGURE diagrammatically depicts apparatus embodying various features of the invention wherein the heat of compression from an ice-making unit is employed to efficiently heat water as a part of a hot water supply system.

DETAILED DESCRIPTION OF THE PREFERRED EMBODIMENT

Illustrated in the drawing is a hot water storage tank 11 and an ice-maker 13. Arranged therebetween is a refrigeration-heat generation unit 15 which is employed to freeze and harvest the ice in the ice-maker 13 and to heat the water for the storage tank 11. The ice-maker 13 includes an evaporator 17 which may be any of the commonly known forms of evaporators wherein cold refrigerant vapor is conducted through a sinuous coil or the like in heat-conducting relationship with an ice-forming surface. For example, a plurality of outer and inner tubes closed at each end can be used to form ice on the interior and exterior surfaces by supplying refrigerant to the lower ends of the hollow annular spaces. A water reservoir 19 is provided below the evaporator 17 which has an inlet valve 21 that is controlled by a float so as to maintain the desired level of water within the reservoir. A pump 23 takes its intake from the reservoir and supplies water through a vertical line 25 to an overhead distributor 27 located above the evaporator. The distributor 27 contains a plurality of holes which are spaced horizontally across the evaporator to assure there is a film of water descending along all the evaporator ice-freezing surfaces. The water from the film that is not frozen drips through a diagonally oriented screen 29 and returns to the reservoir 19. A rotary breaker 31 is operated by an electric motor 33 during harvesting so as to break the ice into pieces of the desired size which fall onto the diagonal screen 29 and then slide past the reservoir and enter an underlying ice bin 35.

The refrigeration-heat generation unit 15 includes a compressor 37 which is designed to run continuously, driven by an electric motor, so long as the equipment is in operation. The compressor 37 discharges through an exit line 39 to a condenser 41, and liquid refrigerant from the condenser flows through a line 43 to a receiver. The compressor 37 draws its suction from an accumulator 45 which contains a heat-exchange coil 47, the purpose of which is described hereinafter.

The condenser 41 preferably includes a pair of vertical pipes 49 which contain clean-out caps 50, 51 at the top and bottom ends and which are joined by a short connector 53 just above the bottom. In order to meet certain local plumbing codes and to facilitate obtaining listings from certifying agencies, the condenser may be constructed so that two metal walls separate the high-pressure refrigerant (usually a chlorofluorocarbon) from the potable city water being heated. Clean out on the water-side is facilitated by the straightline design with both top and bottom caps 50, 51. The hot-gas line 39 from the compressor 37 is joined to a coil 55 of copper tubing or the like which is wound about and in contact with the exterior surface of the pair of parallel pipes 49. If desired, the pipes and coils of the condenser 41 may be placed within an insulated outer jacket as indicated by the dotted outline on the drawing.

In operation, the high-pressure hot gas from the compressor 37 gives up its heat to the water being circulated on the interior of the pair of interconnected pipes 49, heating the water and condensing the high-pressure refrigerant to liquid. A refrigerant is preferably chosen which has the desired temperature-pressure characteristics for operation within the desired range. For example, R-12 (dichlorodifluoromethane) may be used which may be at a temperature of 240° to 270° F. at the outlet pressure of the compressor, e.g., about 172 psia (11.7 atm.), which is substantially above its boiling point of about 120° F. at that pressure.

The condensed high-pressure refrigerant, which is preferably at a temperature of about 110° F. when it leaves the top of the condenser 41, travels through the line 43 toward a receiver 57. The line 43, at a location close to the entry to the receiver 57, includes a restrictor 59 that is sized to restrain the mass flow therethrough when gas is present but which causes a pressure drop of only about 3 psi in the flowing liquid refrigerant. The restrictor 59 may be a short capillary section or a suitably sized orifice. Although its characteristics may vary somewhat, it preferably does not create a pressure drop of more than about 10 psi in a flowing subcooled, liquid refrigerant stream during ice-making and is effective during harvesting to maintain a back pressure against which the compressor operates in the range of about 170 to 175 psia for R-12 refrigerant. The amount of refrigerant liquid employed in the equipment is such as to normally maintain a level above the entry point of the line 43 but below the top of an upper port 61 in the receiver 57. Because the fluid refrigerant will be at equilibrium at the temperature normally within the receiver, i.e., about 110° F., there will be a head of vapor at this temperature in the upper portion of the receiver 57.

During ice-freezing operation, a solenoid valve 63 opens in a supply line 65 leading to the evaporator 17 and permits flow of the high-pressure liquid toward the evaporator. A variable-flow expansion valve 67 is provided to control the flow rate at which refrigerant is supplied to the evaporator 17. The liquid refrigerant enters the liquid supply line 65 at a point near the bottom of the receiver 57 and then passes through the bottom of the accumulator 45 where it flows through the heat-exchange coil 47 before it reaches the solenoid valve 63. During its travel through the heat-exchange coil 47, the high-pressure liquid is subcooled below its normal residence temperature in the receiver 57 by evaporating any low-pressure liquid refrigerant that may be present in the accumulator 45 or by warming the vapor which will be present there.

The major portion of the high-pressure liquid flashes to vapor at the expansion valve 67 when it drops to approximately 36 psia, i.e., the pressure that is maintained in the evaporator 17 by the compressor 37, and its temperature accordingly drops to about 20° F. The incoming cold refrigerant fluid normally enters at a location near the bottom of the evaporator and discharges from an upper location after picking up heat from the water which is being frozen on the exterior surface of the evaporator. A physical property, e.g., the temperature, of the vapor in a return line 69 from the evaporator 17 is monitored by a temperature sensor 71, and if it rises above a desired level, e.g., about 25° F., an overall control system 73 or a direct thermostatic connection adjusts the expansion valve 67 to open wider to allow a greater flow of refrigerant through the evaporator coil. Alternatively, the pressure of the vapor could be monitored. Under desired operating conditions, there is some liquid present in the refrigerant stream for most of its travel path through the evaporator thus maintaining the 20° F. temperature. The low pressure vapor flows to the accumulator 45 whence it is sucked into the compressor via a line 75.

After about fifteen minutes of freezing operation, the ice which is forming on the surface of the evaporator 17 has reached its desired thickness, and the ice-maker 13 is ready to harvest. The control system 73 includes a timer which begins to run at the start of freezing cycle and is adjustable to set a time of about fifteen minutes duration. The timer signals the control system 73 to close the solenoid valve 63, stop the pump 23 supplying water to the distributor 27 and open a harvest valve 77, which is disposed in a branch line 79 which leads from the top of the receiver 57 and connects to a tee 81 in the evaporator supply line 65. The motor 33 also energized to rotate the rotary ice-breaking bars 31.

The opening of the solenoid-controlled harvest valve 77 causes the high-pressure gas from the receiver, which was at a residence equilibrium temperature of about 110° F., to immediately drop to a pressure of about 151 psia (10.3 atm. ) and flow through the branch line 79 and the supply line 65 to the evaporator 17. Moreover, additional liquid in the receiver 57 will flash to vapor at a gradually decreasing temperature, that will approach about 55° F. and a pressure of about 67 psia (4.5 atm.). This flowing vapor enters the bottom of the evaporator tubing where it gives up heat to the cold evaporator assembly. The heat which is released melts the ice bond between the ice that has earlier been frozen and the surface of the evaporator, while simultaneously causing the temperature of the vapor to drop to its boiling point at this pressure, with some of it condensing on the interior wall of the evaporator coil. This hot vapor efficiently heats the evaporator and should cause harvesting of the ice in less than a minute, e.g., in about 45 seconds. The liquid refrigerant which is condensed inside the evaporator tubing during the harvesting cycle is carried through the return line 69 into the accumulator 45 where it will be momentarily trapped at the bottom.

During the harvesting cycle, the high-pressure liquid refrigerant in the receiver 57 continues to flash to vapor as vapor exits through the upper branch line 79 causing an evaporative cooling effect which will lower the temperature of the fluid to about 55° F. during the period necessary for harvesting; however, the compressor is able to operate efficiently during harvesting and continue to supply heat to water for the storage tank 11. During this period, the presence of the condensed refrigerant being returned through the line 69 to the accumulator 45 has no overall effect upon the operation of the compressor 37 because an inlet flow of gas continues. This higher pressure gas entering the compressor during harvest (i.e., 67 psia vs. 36 psia) will have a greater density, and accordingly the weight of hot vapor being pumped by the compressor 37 operating at the same speed will increase, resulting in a slight increase of the discharge pressure of the liquid that will be leaving the condenser 47. For example, the compressor may normally pump 8 lbs. of refrigerant per minute during ice-making and increase to 10–11 lbs./min. during harvesting when the outlet pressure may rise slightly. This increased quantity of liquid refrigerant, together with some high-pressure vapor, flows through the restrictor 59, and some liquid flashes at the significantly lower pressure of the receiver when the valve 77 in the branch line 79 is open. This flashing increases the amount of available vapor for harvesting and, importantly, achieves this objective without significantly lessening the heat which is continuously being supplied to the circulating water in the condenser 41 from the hot vapor discharged by the compressor.

The water storage tank 11 is appropriately sized so as to preferably provide an adequate reservoir of water to cool the condenser 41 during intended ice-making operations. Depending upon the needs of a particular customer, the hot water from an upper exit 83 from the storage tank 11 may be used directly or can be used as a source of preheated water for supply to a final water-heating operation using combustion or resistance heating to further raise its temperature. The warm water will rise within the tank 11 because of its lower density, and accordingly, the cooler water is withdrawn through a lower outlet 85 leading to a tee 87 into one arm of which a supply of make-up water from the city water supply is also connected. The tee 87 leads to the intake of a centrifugal water pump 89 which circulates the cool water upward through a supply line 91 leading to the water pipes 49 in the condenser. The pump 89 is sized to circulate the desired amount of water through the condenser 41 for normal operation. It may be driven by a variable speed electric motor, if desired, and the control system 73 can be used to make adjustments to the rate of circulation by monitoring the temperature of the liquid refrigerant exiting from the condenser by a temperature sensor 93 placed in thermal contact with the exit line 43.

Control of the time of harvesting will normally also be by means of the timer in the control system 73. As soon as harvesting is completed, the harvest valve 77 is closed, and the timer begins the next ice-freezing cycle. The water pump 23 is restarted, and the ice-breaker driving motor 33 is stopped.

At the beginning of a freezing cycle, the now-repressurized liquid refrigerant in the receiver 57 might initially be at about 55° F., and it may initially be subcooled to about 40° F. as it travels through the heat-exchange coil 47 and evaporates accumulated lower pressure liquid refrigerant in the accumulator 45. This subcooled liquid refrigerant picks up more heat when it evaporates than does warmer liquid refrigerant, and a lower percentage of the refrigerant vaporizes when passing through the expansion valve 67, thus carrying a greater percentage of liquid with it to the evaporator. In this manner, much of the heat energy which was employed during harvesting is reclaimed at the accumulator in the form of subcooled liquid refrigerant; as a result, only a very small amount of the heat which would normally be transferred to the circulating water in the condenser is lost during the harvest-portion of the overall cycle—thus maintaining a steady heat output at the condenser 41 in the form of hot potable water.

The relatively cool liquid refrigerant exiting from the receiver 57 through the conduit 65 is replaced by gradually warmer liquid refrigerant flowing through the restrictor 59 which slowly descends as the ice-freezing operation continues. Eventually all of the harvest-condensed liquid trapped in the accumulator 45 is vaporized during the initial portion of the following ice-freezing cycle, and during the last portion of the freezing period, the expansion of refrigerant will be similar to that achieved in a normal ice-maker with the usual percentage of flash gas leaving the expansion valve. The overall performance of the equipment has increased efficiency, and a coefficient of performance (C.O.P.) of about 3.0 is achievable.

The size of the receiver 57 is determined by the approximate amount of heat required to warm the evaporator assembly from a normal freezing temperature of about 20° F. to a temperature of about 40° F. at which the bond to the ice will be readily broken. Using R-12 refrigerant, it is calculated that there will be about 15 to 20 BTU's per pound of refrigerant in the receiver available for harvesting the ice formed on the surface of the evaporator. Accordingly, if a harvest will require about 300 BTU's to complete, the receiver will be designed so as to hold between about 15 and 20 pounds of liquid refrigerant at the completion of a normal freezing cycle. In addition, the continuous supply of liquid from the condenser 41, which will partially flash through the restrictor 59 during the time of harvest, will add about an additional 20% to the available amount of harvest gas volume and thereby provide a substantial safety factor. The restrictor 59 may, for example, be a 6 inch length of 3/16 in. OD copper tubing having an 0.032 in. wall that will normally create only a pressure drop of about 3 psi during freezing operations; however, during harvesting operation, the pressure drop may be over 100 psi using R-12, e.g., the outlet pressure from the compressor 37 being about 174 psia and the pressure in the receiver dropping to as low as about 67 psia. This increase in mass flow through the restrictor 59 at the high $\Delta P$ will be about the same as the increase in mass flow through the compressor, and the condenser output of heat to the potable water will remain substantially constant throughout the harvesting cycle.

There should be warm refrigerant in the receiver 57 at the time the harvest cycle is ready to begin so that there will be hot vapor available to supply through the branch line 79 to the evaporator. Accordingly, the control system 73 is preferably set to monitor the output temperature of the refrigerant leaving the condenser, via the sensor 93, as the ice-freezing cycle nears completion. A throttling valve 95 is provided in the water supply line 91 to the condenser, and when signaled by the control system 73 based upon a decrease in the outlet temperature of the liquid refrigerant, it will reduce the flow of water to the condenser until the temperature rises to the desired valve. This valve 95 assures the presence of liquid refrigerant at the desired temperature immediately prior to and during the harvesting cycle.

Normally, the heated water from the condenser 41 flows through a line 96 and re-enters the tank 11 through a central return, which may terminate in a downwardly slotted diffuser pipe 97 that causes the warmer returning water to flow a short distance downward to lose its velocity and minimize mixing with the cooler water in the tank that is slowly descending. Should the storage tank 11 become filled with water at a temperature of about 120° F. the condensing capability of the water being supplied by the pump 38 would be insufficient to condense the hot vapor exiting from the compressor to the degree desired, and rather than suffer a decrease in ice output and an increase in power input, which is uneconomical, a valve 99 is provided in a hot water branch line leading to an ambient-air heat-exchanger 100 or the like. When the temperature of the liquid in the supply line 91 reaches too high a temperature, e.g., about 116° F., it will be reflected by a proportional rise in the temperature monitored by the sensor 93, and the valve 99 is operated so hot water is diverted from the circulating loop and circulated through the ambient-air heat-exchanger 100 until the liquid refrigerant temperature drops to a preset value, e.g., about 112° F.

Normally the size of the storage tank 11 utilized should be ample to provide a ready reservoir of water sufficient to prevent the need for such diversion. Optionally, if the cost of potable water should be quite low in a particular location, it may be feasible to eliminate the outdoor, ambient-air heat-exchanger and simply dump hot water to a city sewer. Normally, the ice bin 35 will have a cut-off switch near its top that will shut down the ice-maker 13 when it is substantially full of ice by so signaling the control system 73. Accordingly, the smaller the size of the ice bin, the smaller will be the water storage tank that is required.

Overall, the equipment arrangement maximizes the use of the now-useful amount of heat from the ice-maker and, by minimizing the amount of heat spent to periodically harvest the ice, results in an overall machine having an energy performance efficiency greatly exceeding that of other ice-makers available at the present time.

Although the invention has been described with regard to certain preferred embodiments which constitute the best mode presently known to the inventors for carrying out their invention, it should be understood that various modifications as would be obvious to one having the ordinary skill in this art may be made without departing from the scope of the invention which is set forth in the appended claims. For example, instead of freezing ice directly on its surface, an evaporator may be used to cool a "brine" stream, e.g., a water-ethylene glycol mixture, to a temperature of about 15°-20° F. which is then circulated to the ice-maker location. Should it be desired to provide hot water at a slightly higher temperature, a compressor might be employed that will discharge vapor at a higher pressure and/or a higher boiling point refrigerant, e.g., R-22, might be employed.

Particular features of the invention are emphasized in the claims which follow.

What is claimed is:

1. Apparatus for forming ice in combination with means for heating a liquid such as water, which apparatus comprises ice-making means including an evaporator, means for supplying water to said evaporator for freezing to form ice, a receiver for holding a quantity of refrigerant in liquid form, first conduit means including expansion means for supplying refrigerant from said receiver to serve as a source of cold for said evaporator for the formation of ice thereupon, a compressor, second conduit means for returning expanded refrigerant to said compressor, condenser means, third conduit means connecting said compressor and said condenser, fourth conduit means connecting said condenser to said receiver which includes restrictor means for causing a significant pressure drop thereacross, said liquid-heating means including means for supplying liquid to said condenser where it is heated while condensing said refrigerant, and fifth conduit means for withdrawing refrigerant vapor from an upper region within said receiver and supplying said vapor to said evaporator to harvest ice formed thereon.

2. Apparatus in accordance with claim 1 wherein said second conduit means includes accumulator means for retaining any liquid refrigerant that condenses in said evaporator during the harvesting.

3. Apparatus in accordance with claim 2 wherein said first conduit means includes heat-exchange means between said receiver and said expansion means and located in association with said accumulator means so that liquid refrigerant passes in heat transfer relationship with fluid in said accumulator means.

4. Apparatus in accordance with claim 1 wherein said restrictor means is sized so as to create a pressure drop of not more than about 10 psi in the flow of liquid refrigerant therethrough during normal ice-making.

5. Apparatus in accordance with claim 1 wherein a control system is provided for controlling the supply of refrigerant to said expansion means during an ice-making cycle, for controlling the withdrawal of vapor from said receiver during an ice-harvesting cycle and for operating said compressor continuously during said ice-making and ice-harvesting cycles.

6. Apparatus in accordance with claim 5 wherein said expansion means is adapted to effect variable flow-control and wherein said control system includes means for monitoring a physical property of the returning vapor in said second conduit means and for adjusting said expansion means in response to changes in the physical property being monitored.

7. Apparatus in accordance with claim 1 wherein a water storage tank is provided and means is provided for withdrawing water from a lower region therein, circulating said withdrawn water through said condenser to heat the water and returning the heated water to said storage tank.

8. Apparatus in accordance with claim 7 wherein means is provided for monitoring the temperature of the refrigerant in said fourth conduit means and means is provided for adjusting the flow of water through said condenser means in response to changes in the temperature of the refrigerant in said fourth conduit means.

9. A method of forming ice and heating a liquid such as water, which method comprises withdrawing liquid refrigerant from a reservoir of refrigerant in liquid and vapor form and expanding said withdrawn refrigerant to vapor to lower its temperature below the freezing point of water and create a cold source, supplying water and said cold source to ice-maker means and freezing said water to form ice thereupon, returning said expanded refrigerant vapor to a compressor and discharging hot high-pressure vapor therefrom to a condenser, supplying liquid to the condenser where it is heated while condensing said high-pressure refrigerant vapor, returning refrigerant from said condenser to said reservoir through restrictor means which causes a significant pressure drop therein, and upon completion of ice formation of a desired thickness, halting said supply of said cold source to said ice-maker means, withdrawing relatively warm refrigerant vapor from said reservoir and supplying said withdrawn warm vapor to said ice-maker means to harvest said ice formed thereon whereby said returning of said high-pressure refrigerant to said reservoir through restrictor means assures that the transfer of heat to the liquid being heated in said condenser remains substantially constant throughout said harvest.

10. A method in accordance with claim 9 wherein liquid refrigerant that condenses in the ice-maker means during said time of harvest is accumulated in a region upstream of said compressor and is subsequently vaporized by heat-exchange with said withdrawn liquid refrigerant in the next ice-freezing cycle to subcool said withdrawn liquid refrigerant prior to expanding same.

11. A method in accordance with claim 9 wherein a physical property of the vapor flowing toward the compressor is monitored and the rate at which said withdrawn liquid refrigerant is being expanded is varied relative to changes in said physical property being monitored.

12. A method in accordance with claim 9 wherein said compressor is operated continuously during said ice-making and said ice-harvesting.

13. A method in accordance with claim 9 wherein water is withdrawn from a lower region in a water storage tank, circulated through the condenser to heat said water, and said heated water is returned to the storage tank and wherein the temperature of said refrigerant returning from said condenser is monitored and said circulation flow of water is varied relative to changes in said monitored temperature.

* * * * *